US007293677B2

(12) United States Patent
Wempe et al.

(10) Patent No.: US 7,293,677 B2
(45) **Date of Patent: *Nov. 13, 2007**

(54) PORTABLE FLUID DELIVERY SYSTEM

(76) Inventors: Patrick L. Wempe, 5747 SE. Stanley Rd., Tecomseh, KS (US) 66542; Peter Cionitti, 14592 S. Twilight Ct., Olathe, KS (US) 66062

( * ) Notice: Subject to any disclaimer, the term of this patent is extended or adjusted under 35 U.S.C. 154(b) by 0 days.

This patent is subject to a terminal disclaimer.

(21) Appl. No.: 11/484,097

(22) Filed: Jul. 11, 2006

(65) Prior Publication Data

US 2006/0249539 A1 Nov. 9, 2006

(51) Int. Cl.
*B67D 1/07* (2006.01)

(52) U.S. Cl. ..... 222/192; 222/529

(58) Field of Classification Search ..... 222/192, 222/529, 297, 397
See application file for complete search history.

(56) References Cited

U.S. PATENT DOCUMENTS

| | | | | | |
|---|---|---|---|---|---|
| 2,529,645 | A | * | 11/1950 | Winks et al. | 222/397 |
| 2,799,315 | A | | 7/1957 | Strasburg | |
| 2,950,748 | A | | 8/1960 | Olinghouse | |
| 4,029,136 | A | | 6/1977 | Jacoby | |
| 5,105,958 | A | * | 4/1992 | Patton | 215/388 |
| 5,564,605 | A | * | 10/1996 | Heidbreder | 222/192 |
| 6,407,668 | B1 | | 6/2002 | Beham | |

* cited by examiner

*Primary Examiner*—Philippe Derakshani

(57) ABSTRACT

A dispenser is located within a golf bag and remotely controlled and coupled to a linear actuator, which extends the fluid dispenser outside of the golf bag upon actuation of the remote control. The remote control can also be actuated to cause the fluid dispenser to retract into the golf bag to hide the fluid delivery system from view.

20 Claims, 8 Drawing Sheets

222
202
214
212
210
208
206
204
217
216
10
20
18
32
16
194
196
198
200
192
12
14
22
110
112
114

PORTABLE FLUID DELIVERY SYSTEM

BACKGROUND OF THE INVENTION

1. Field of the Invention

The present invention relates in general to a fluid delivery system and, more particularly, to a fluid delivery system provided within a golf bag.

2. Description of the Prior Art

It is well known in the art to provide mobile fluid delivery systems such as sport bottles and canteens. It is also known in the art to provide fluid pouches which may either be carried or strapped to a user's back for delivery of a fluid during exercise or other outdoor activities. One drawback associated with such devices is that they typically must be carried by the user during use. An additional drawback is that the delivery systems typically do not provide a useful mechanism for delivering fluid to a plurality of users. Therefore, it would be desirable to provide a portable fluid delivery system which need not be carried by a user, and which provides for delivery of fluid to a plurality of users.

It is also known in the art to provide kegs and the like for delivery of fluid to a large number of users. One drawback associated with such systems is even the small kegs and "party balls" are unwieldy and difficult to use in association with sports such as golf. It would, therefore, be desirable to provide a portable fluid delivery system which delivers fluid to a plurality of users, but is capable of being transported within a golf bag.

The difficulties encountered in the prior art discussed hereinabove are substantially eliminated by the present invention.

SUMMARY OF THE INVENTION

In an advantage provided by this invention, a golf bag is provided with a portable fluid delivery system.

Advantageously, this invention provides a golf bag with a fluid delivery system with a capacity of at least two and one-half liters.

Advantageously, this invention provides a golf bag with a fluid delivery system, and dispenser system with a plurality of cups.

Advantageously, this invention provides a golf bag with a fluid delivery system which conceals the fluid delivery system.

Advantageously, this invention provides a golf bag with a fluid delivery system which may be remotely actuated.

Advantageously, this invention provides a golf bag with a fluid delivery system which allows for pressurized fluid delivery.

Advantageously, this invention provides a golf bag with a fluid delivery system with means for insulating the fluid prior to delivery.

Advantageously, in the preferred example of this invention, a fluid delivery system is provided with a golf bag and means for retaining a plurality of golf clubs at least partially within the golf bag. A fluid container is also provided at least partially within the golf bag. The fluid container contains a fluid and means are provided for transferring the fluid from the fluid container to a fluid dispenser.

In the preferred embodiment of the invention, a remote control unit is coupled to a linear actuator to remotely actuate the dispenser to move from a position located within the golf bag to a position outside of the golf bag. Means are also provided for manually pumping pressurized air into the fluid container to allow the dispenser to obtain fluid from the system.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
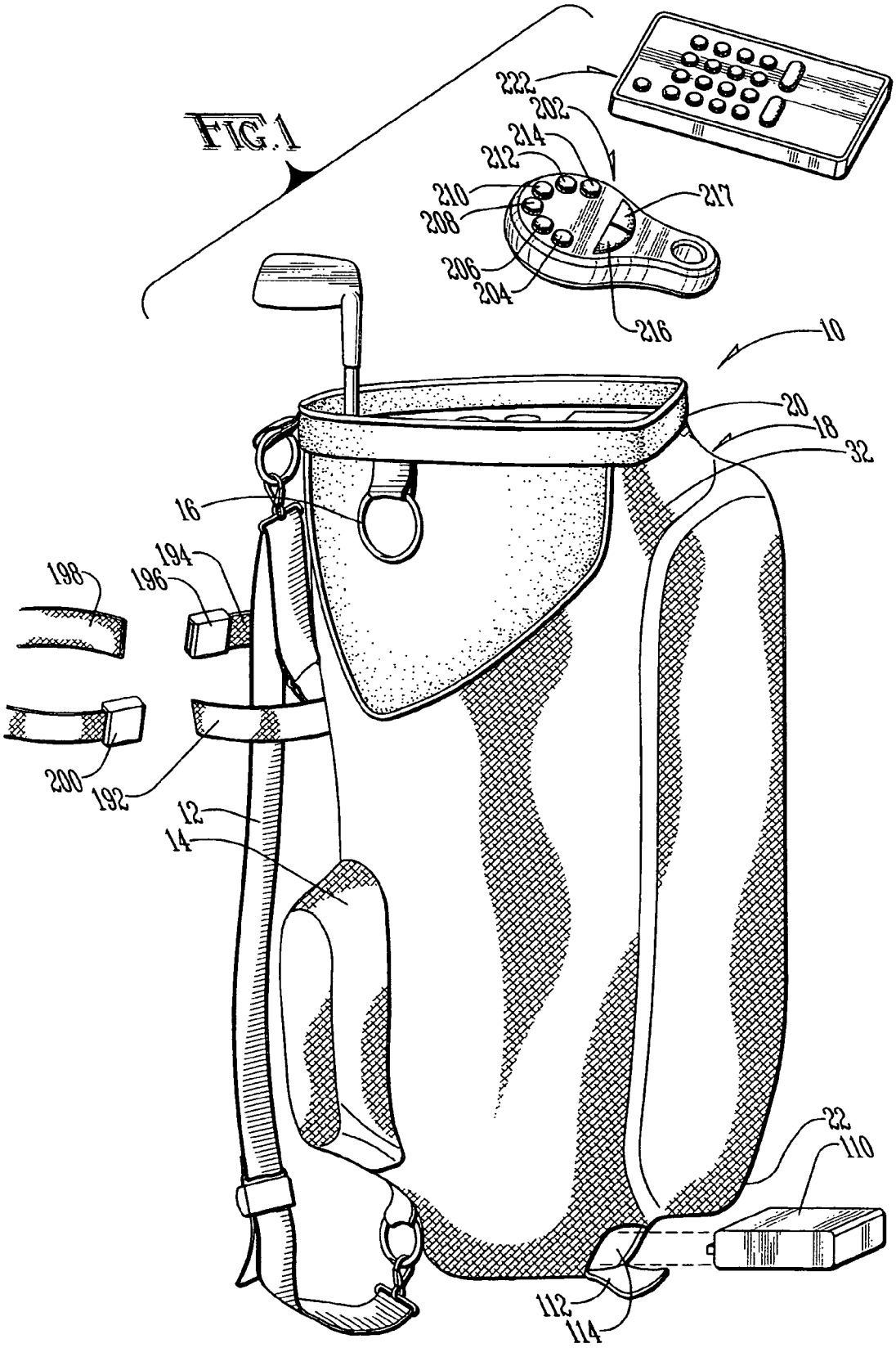
FIG. 1 illustrates a side elevation of the golf bag of the present invention.

A golf bag according to the present invention is shown generally as (10) in FIG. 1. The golf bag (10) includes a strap (12), several zipper pockets (14) and a towel retainer (16), such as those known in the art. The golf bag (10) includes a body (18), having a top (20) and a bottom (22).

Figure 2:
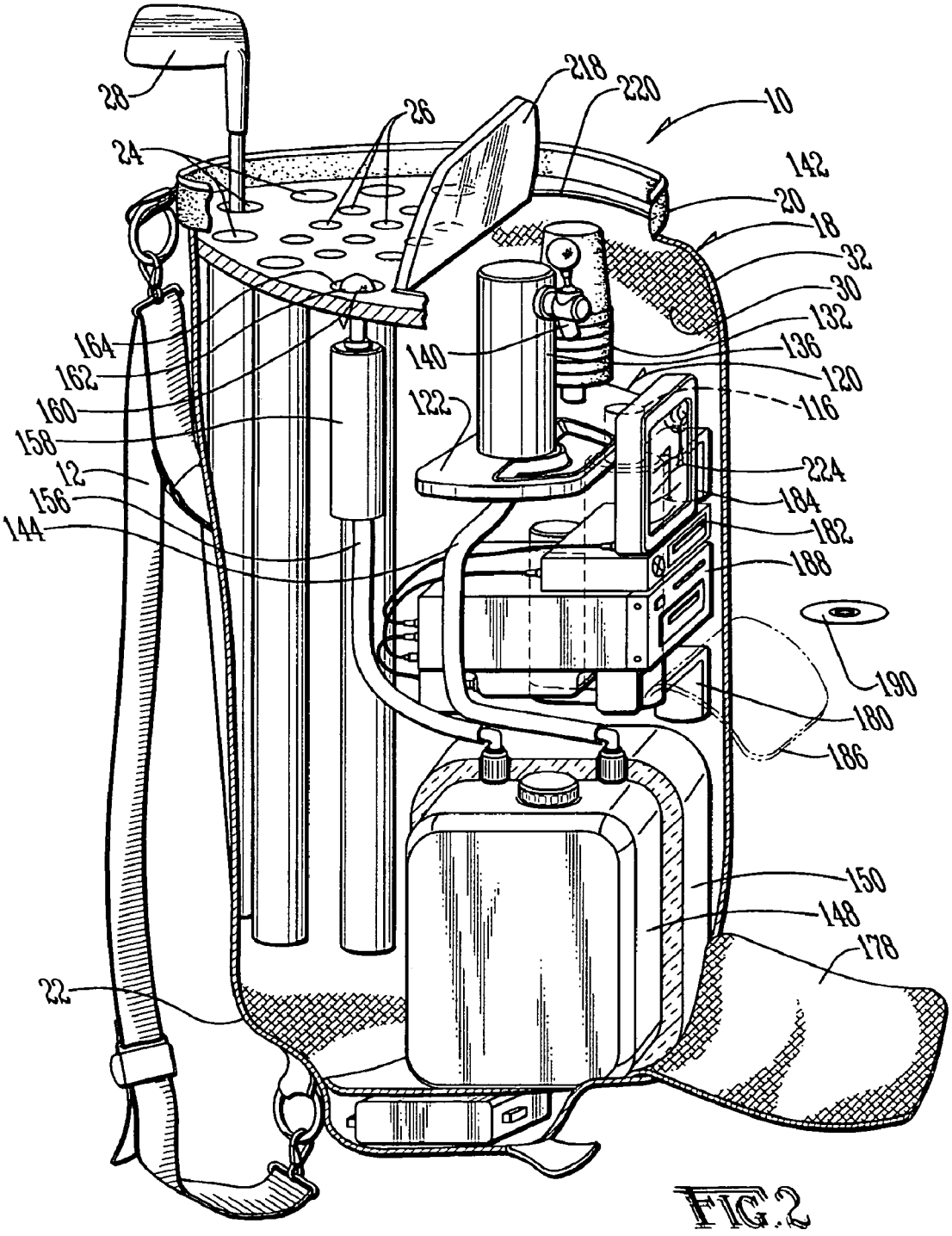
FIG. 2 illustrates a side elevation in phantom of the golf bag of FIG. 1.

As shown in FIG. 2, the top (20) is provided with a plurality of ejector tubes (24) and a plurality of stationary tubes (26), sized to accommodate a golf club (28). The stationary tubes (26) are similar to those known in the art and are preferably constructed of an impact resistant plastic. Although only six ejector tubes (24) are shown with seven stationary tubes (26), any desired ratio of ejector tubes (24) and stationary tubes (26) may be utilized.

Figure 3:
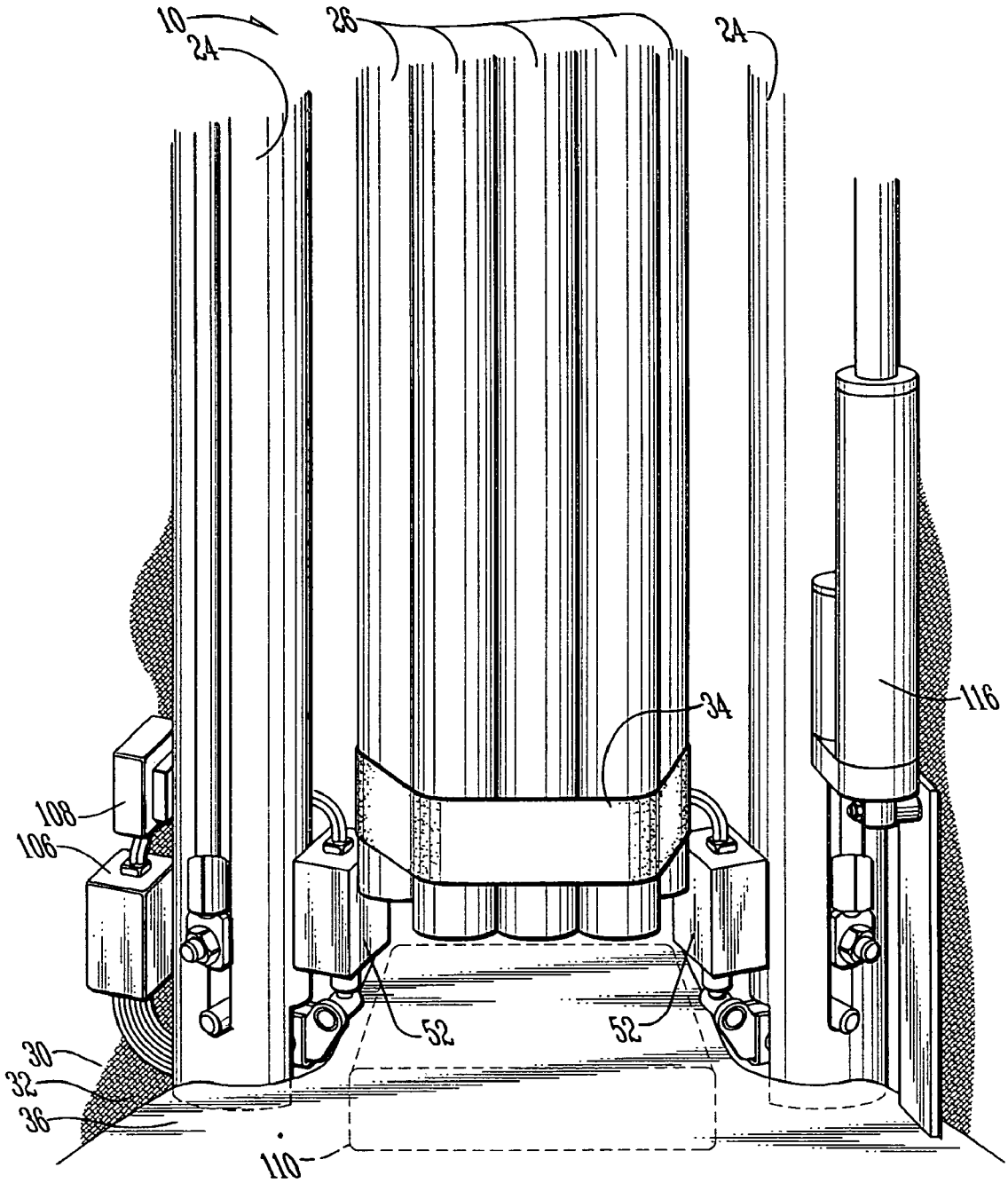
FIG. 3 illustrates a perspective cutaway view of the lower interior of the golf bag of FIG. 1.

As shown in FIG. 3, the ejector tubes (24) are provided along the interior face (30) of the body (28) of the golf bag (10). The interior face (30) is preferably constructed of a high-impact plastic, which is covered with a pliable vinyl covering (32). The vinyl covering may be colored, detailed or provided with text or logos as desired. (FIGS. 1 and 3).

As shown in FIG. 3, the stationary tubes (26) are secured to the interior face (30) of the golf bag (28) with small clips (34) and the stationary tubes (26) rest on a high-density plastic platform (36) which, in turn, tests on a support wall (37). The support wall (37) is secured to a larger high-density plastic platform (39) secured to the bottom (22) of the golf bag (10). The platform (36) is secured to the interior face (30) of the golf bag (10) by bolts or similar securement means known in the art. As shown, the platform (36) is constructed of dimensions which allow the ejector tubes to extend past the platform (36). (FIGS. 1 and 3). As the ejector tubes (24) are substantially similar in construction, the description will be limited to a single ejector tube (24).

Figure 5:
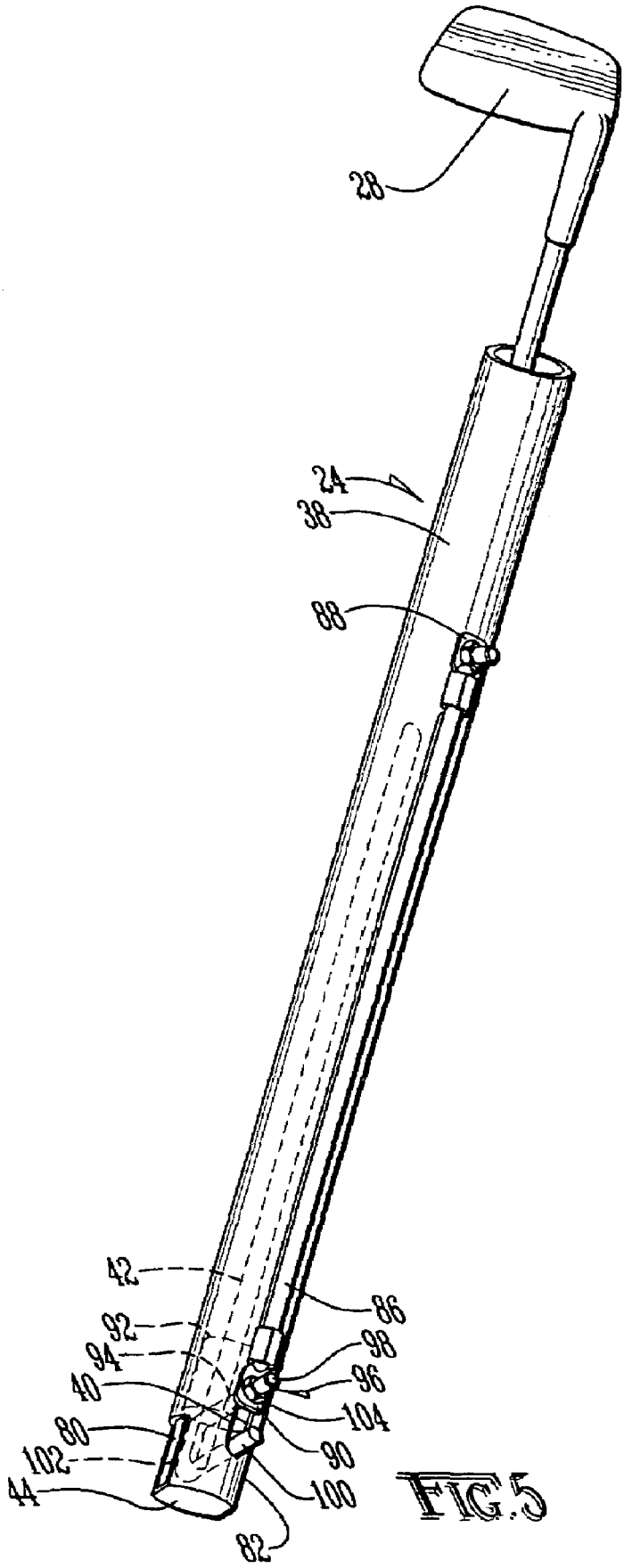
FIG. 5 illustrates a side perspective view of an ejector tube of the golf bag of the present invention.

As shown in FIG. 5, the ejector tube (24) is a hollow steel tube (38) approximately eighty-nine centimeters long, having an interior diameter of approximately 3.2 centimeters. The tube (38) is provided with a first slot (40) and a second slot (42), running from approximately one centimeter from the bottom (44) of the tube (38) for a length of about forty centimeters and a width of about one centimeter.

Figure 6:
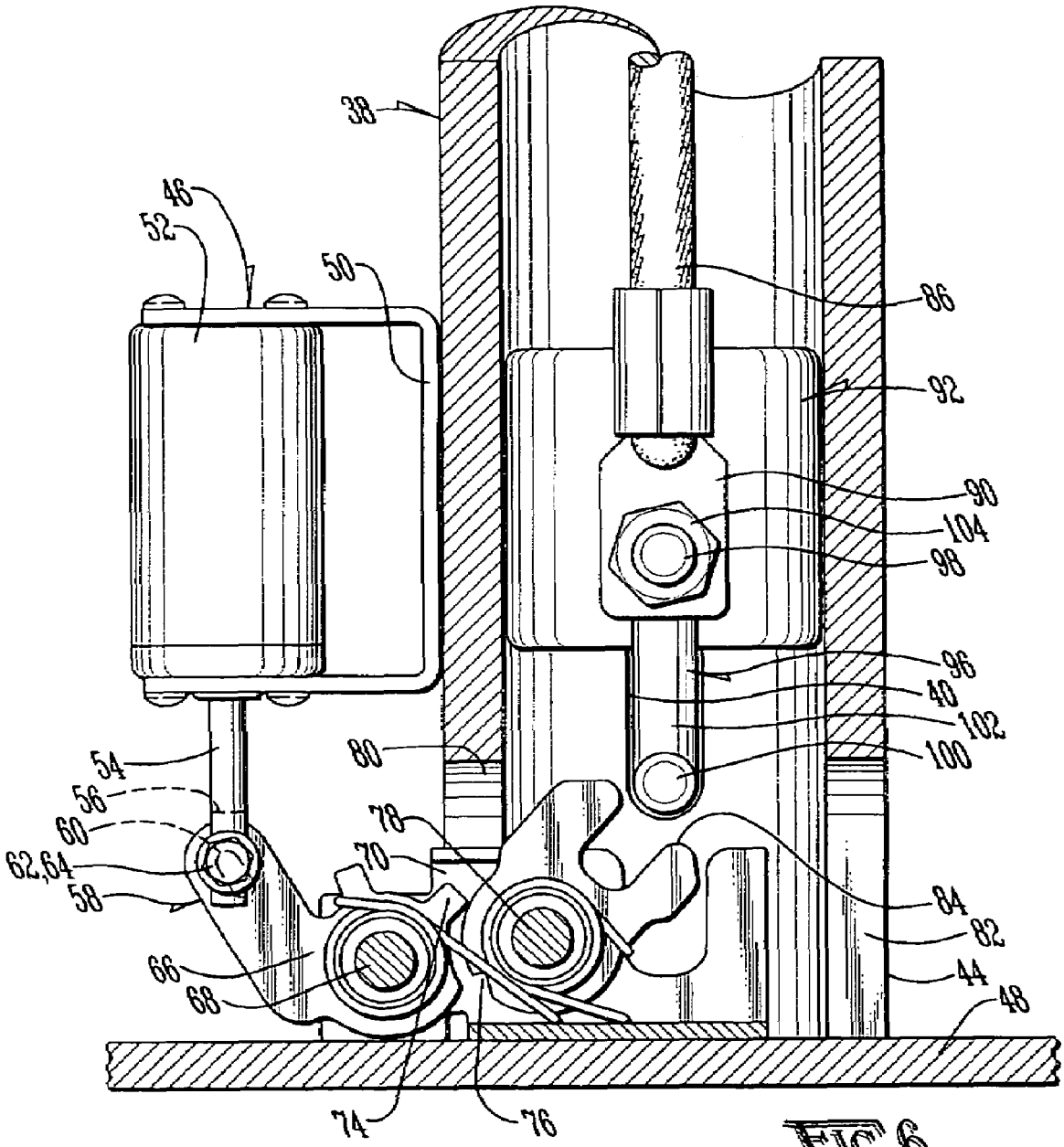
FIG. 6 illustrates a side elevation of the ejector actuator of the present invention.

As shown in FIG. 6, coupled to the bottom (44) of the tube (38) is an electronic trigger assembly (46). The trigger assembly (46) includes a steel bottom plate (48) and a steel side plate (50), welded to one another and to the bottom (44) of the tube (38). Welded or otherwise secured to the side plate (50) is a pull-type solenoid (52) provided with a shaft (54) such as those well known in the art. The shaft (54) is provided with a slot (56) into which is provided a steel linkage (58). The shaft (54) is also provided with a pair of holes (60) to accommodate a bolt (62), which passes through a hole (not shown) in the linkage (58). The bolt (62) is secured to the shaft (54) by a nut (64).

The linkage (58) is pivotally coupled to a secondary steel linkage (66) by a bolt (68). The secondary steel linkage (66) is coupled to a bracket (70) by a bolt (72). The bracket (70) is preferably constructed of steel and welded or otherwise secured to the bottom plate (48) of the electronic trigger assembly (46). The secondary steel linkage (66) is pivotally coupled to the trigger bar (74) of a standard, single rotor latch (76) by a bolt (78). As shown in FIG. 5, the tube (38) is provided with a slot (80), preferably one and one-third centimeters wide and running five centimeters from the bottom (44) of the tube (38). As shown in FIG. 6, the latch (76) is provided partially within the slot (80) to a point where the catch (84) is positioned preferably centrally within the tube (38). The latch (76) is preferably of a spring-loaded variety, which locks in response to a bar being pressed into contact with the catch (84) sufficiently to rotate the catch (84) to a substantially horizontal position. The catch (84) remains locked in position by the latch (76) until the top of the trigger bar (74) is rotated in a clockwise direction, thereby causing the spring-actuated latch (76) to release the catch (84).

As shown in FIG. 5, rubber surgical tubing (86) is coupled to the tube (38) by an eyelet (88), which, in turn, is clamped to the tubing (86). The opposite end of the tubing (86) is secured to an eyelet fastener (90) by compression of the neck of the eyelet fastener around the tubing (86), or similar securement means. The rubber surgical tubing (86) is preferably of a length, diameter, resilience and construction sufficient to motivate a golf club to a speed of preferably at least one meter per second, more preferably, at least three meters per second and most preferably between four meters per second and ten meters per second.

Figure 7:
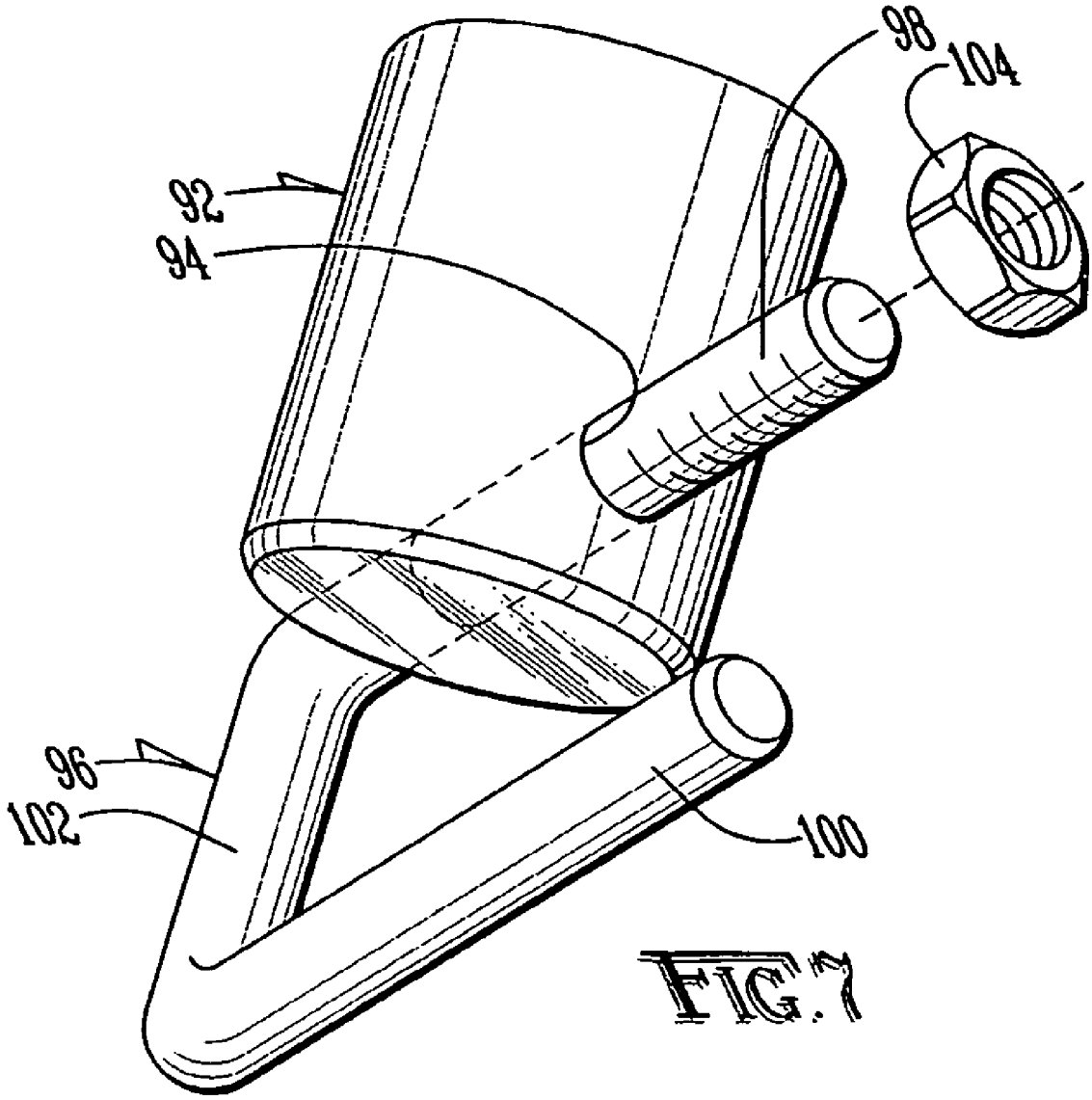
FIG. 7 illustrates a side elevation of the ejection cylinder and U-bolt assembly of the present invention.

As shown in FIG. 7, a solid PVC cylinder (92) is provided with a height of approximately 3.175 centimeters and a diameter of approximately 3.175 centimeters. The cylinder (92) is also provided with a hole (94) through which is provided a steel U-bolt (96). The U-bolt (96) is provided with a threaded leg (98) and an unthreaded leg (100), with a connection bar (102) separating the central axes of the legs (98) and (100) by a distance of two centimeters.

Figure 4:
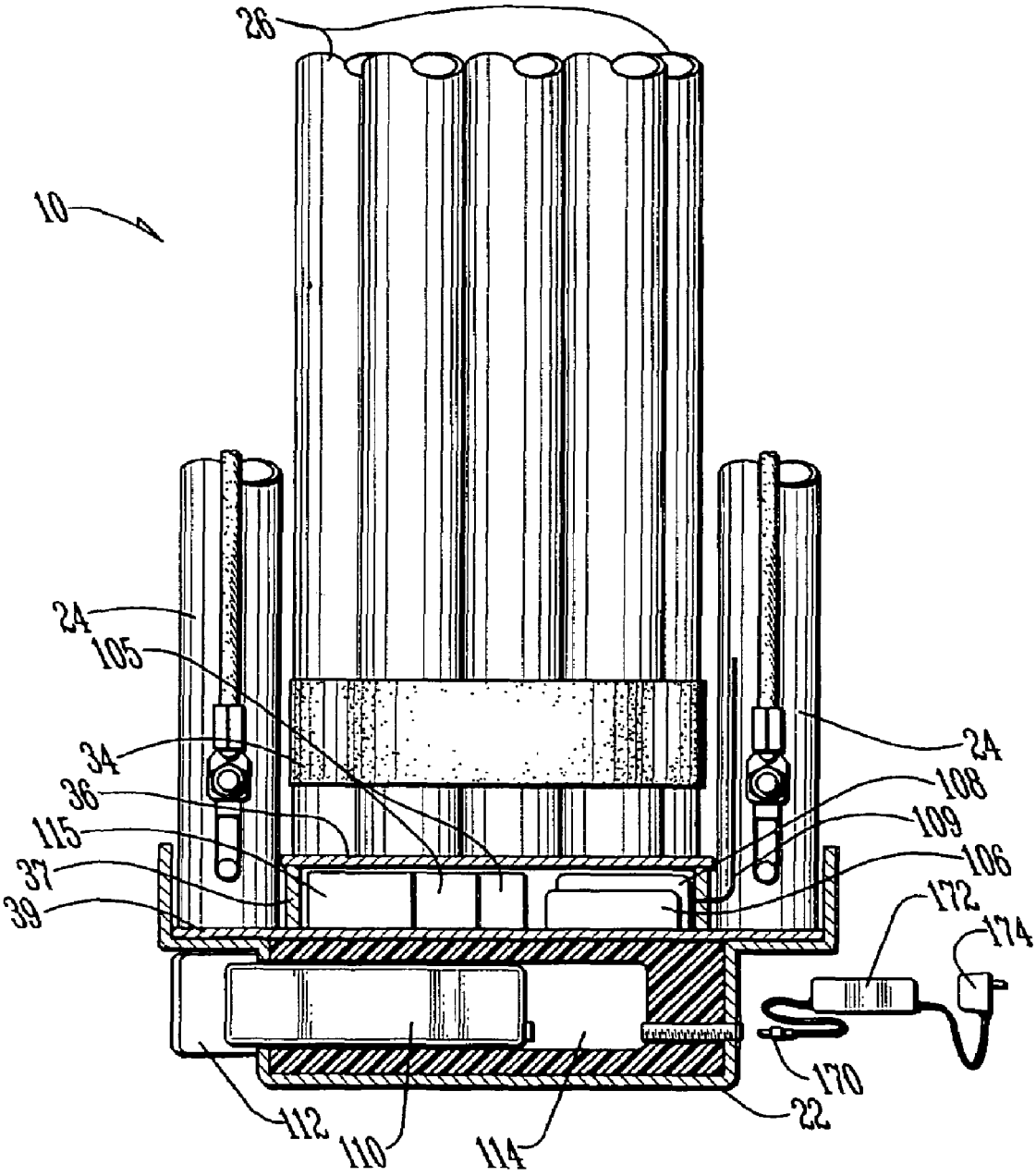
FIG. 4 illustrates a side elevation in partial cutaway of the lower portion of the golf bag of FIG. 1.

As shown in FIG. 5, the cylinder (92) is provided into the tube (38), whereafter the threaded leg (98) of the U-bolt (96) is provided through the hole (94). The unthreaded leg (100) extends through the slot (40), with the connection bar (102) being maintained within the slot (42). The eyelet fastener (90) is provided over the threaded leg (98) and secured thereto by a nut (104) in a manner such that the ends of both the legs (98) and (100) extend through the slot (40), and the connection bar (102) slides within the slot (42), to guide the cylinder (92) and prevent the cylinder (92) from becoming bound within the tube (38) during the actuation described below. The unthreaded leg (100) is preferably mounted to be received within the catch (84) and actuate the latch (76) to retain the catch (84) upon depression of the cylinder (92) through the tube (38) by a golf club (28). (FIGS. 1 and 4).

As shown in FIG. 3, all of the solenoids (52) are wired via six standard twelve-volt relays (105) to a central processing unit (106) which, in turn, is integrated with a radio frequency receiver (108) and antenna (109). (FIGS. 3 and 4). The central processing unit (106) is electronically coupled to a battery (110) which, in the preferred embodiment, is a rechargeable sealed lead acid battery, such as those known in the art. (FIGS. 1 and 3). In the preferred embodiment, the battery (110) is a PS-12180, 12-volt, 18 AMP hour battery manufactured by Power Sonic of Redwood City, Calif. As shown in FIG. 1, to install the battery (110) in the golf bag (10), a door (112) hingably coupled to the bottom (22) of the golf bag (10) is opened from its releasable closure to reveal a battery compartment (114) located within the bottom (22) of the golf bag (10).

In the preferred embodiment, the bottom (22) is constructed of a heavier, more abrasion resistant plastic material than the interior face (30), to provide the golf bag (10) with rigidity, increased abrasion resistance and protection of the battery compartment (114) from external forces, and from forces associated with unintentional shifting of the battery (110) within the compartment (114). Also, the bottom (22) of the golf bag (10) is preferably constructed with a diameter less than about forty centimeters in diameter, and more preferably, approximately thirty centimeters in diameter, to allow the golf bag (10) to be retained by conventional golf bag retention mechanisms, such as golf carts (not shown) and the like.

Figure 8:
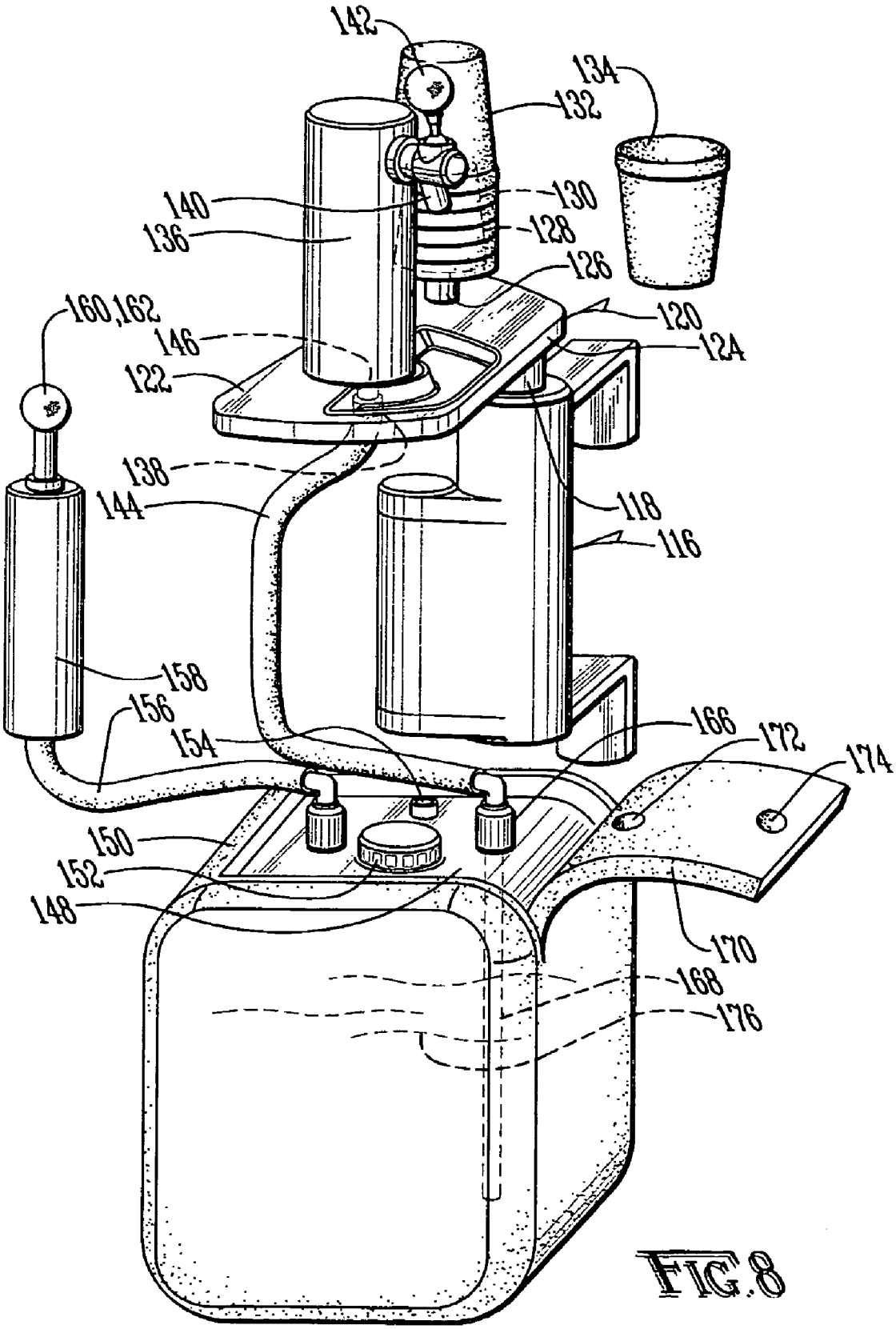
FIG. 8 illustrates a perspective view of the fluid pumping and delivery system of the present invention.

Once the battery (110) has been inserted into the battery compartment (114), the door (112) may be releasably latched as is known in the art to prevent inadvertent removal of the battery (110) from the battery compartment (114). As shown in FIG. 3, also electrically coupled to the central processing unit (106) by standard twelve-volt relays (115) is a linear actuator (116) which, in the preferred embodiment is a twelve-volt linear actuator with a retracted length of 41.3 centimeters, and a stroke length of 30 centimeters. (FIGS. 4 and 8). Although the linear actuator (116) may be of any suitable size, dimension or load, in the preferred embodiment the linear actuator (116) is a Model 6178E linear actuator manufactured by AEI Components of Cerritos, Calif., having a static load capacity of five hundred pounds, a load capacity of one hundred pounds, a speed of 1.3 centimeters per second, and a built in limit switch. As shown in FIG. 3, the linear actuator (116) is bolted or otherwise secured to interior face (30) of the golf bag (10).

As shown in FIG. 8, the shaft (118) of the linear actuator (116) is coupled to a steel bracket (120), having a vertical rear arm (122) and a lateral right-angle side arm (124). The side arm (124) is preferably provided with an upwardly extending steel post (126), extending into and secured to a cup form (128). Although the cup form (128) may be constructed of any suitable dimensions or material, in the preferred embodiment, the cup form (128) is preferably constructed of a Styrofoam interior (130), adhesively secured to a standard plastic cup (132), such as those desired to be utilized for drinking in association with the present invention. Adhesively secured to the Styrofoam (130), the cup (132) provides a mount upon which additional standard cups (134) may be releasably stacked for storage and later use. (FIGS. 2 and 7).

The vertical rear arm (122) is coupled to a tap (136) by a hose clamp (138) or similar means. Although the tap (136) may be of any type known in the art, in the preferred embodiment, the tap (136) preferably extends a sufficient distance above the steel bracket (120) to allow a cup (134) to be inserted between the outlet (140) of the tap (136) and the steel bracket (120). The handle (142) is preferably of a novelty design associated with golf, such as a golf ball or the like. The tap (136) is coupled to plastic tubing by a standard tubing connector (146), such as that known in the art.

As shown in FIG. 8, the tubing (144) is coupled to a fluid container (148) which, in the preferred embodiment is a two and one-half gallon square high-density Polyethylene carboy of food grade quality. The fluid container (148) is preferably friction fit with a resilient, insulative sleeve (150) constructed of any desired insulative material. The fluid container (148) is preferably provided with a screw-on cap (152) in fluid communication with a one-way valve (154) having a predetermined release pressure below that of the pressure containment specifications associated with the fluid container (148). Coupled to the one-way valve (154) is an additional length of tubing (156) coupled to a manual air pump (158), such as those known in the art.

Like the linear actuator (116), the pump (158) is secured to the interior face (30) of the golf bag (10). (FIG. 2). The pump (158) is preferably secured at a height where the handle (160) of the pump (158) is even with the top (20) of the golf bag (10) when the handle (160) is in the lowered position. Preferably, the handle (160) is provided with a novelty top (162), such as a golf ball or the like. As shown in FIG. 2, the top (20) of the golf bag (10) is provided with an opening (164) slightly larger than the top (162) of the handle (160), and which provides sufficient clearance for a user's finger (not shown) to extend through the opening (164), grab the handle (160) and lift the handle for pumping.

As shown in FIG. 8, the tubing (144) coupled to the tap (136) connects to the container (148) via a fluid coupling (166), such as those known in the art. On the interior of the fluid container (148), the coupling (166) is in fluid communication with a hose (168) which extends to the lower-most portion of the container (148). Once the fluid container (148) has been provided with a fluid (176) such as beer or the like, the sleeve (10) is stretched around the fluid container (148) and the tubing (144) and (156) is coupled to the fluid container (148). Thereafter, the fluid container (148) is provided into the golf bag (10) through a zippered door (178) which, thereafter, is zipped shut. (FIGS. 2 and 7).

As shown in FIG. 2, also secured to the interior face (30) of the golf bag (10) by a steel bracket (180) is a twelve-volt stereo receiver (182), such as those well known for use in association with vehicles and the like. In the preferred embodiment, the receiver is provided with an AM/FM tuner, a television receiver, a combination compact disc and DVD player, and is also electrically coupled to a video monitor (184), such as those associated with vehicles and the like. Preferably, the stereo receiver (182) and video monitor (184) are covered with a protective zippered face (186), which may be unzipped to reveal the video monitor (184) and the control elements associated with the stereo receiver (182). Preferably, the compact disc/DVD player (188) component of the stereo receiver (182) is positioned to allow the insertion of compact discs and DVD's (190) laterally into the stereo receiver (182).

As shown in FIG. 4, the battery (110) is also coupled to a connection jack (170) provided in the bottom (22) of the golf bag (10). When it is desired to charge the battery (110), a standard twelve-volt battery charger (172) is coupled to a power source (174) and coupled to the connection jack (170). Once the battery (110) has been charged, the battery charger (172) can be disconnected from the golf bag (10).

As shown in FIG. 1, the golf bag (10) is provided with a web strap (192) on one side, and a web strap (194) on the other side, terminating in a cam buckle (196), similar to those associated in the prior art with straps attached to golf carts for the attachment of golf clubs thereto. Due to the oversized nature of the golf bag (10), many prior art web straps associated with golf carts and the like may not be sufficiently long to encompass the golf bag (10). Accordingly, a web strap (198) associated with a golf cart (not shown) may be coupled to the cam buckle (196) associated with the golf bag (10), and a cam buckle (200) associated with a golf bag (not shown), may be coupled to the web strap (192) associated with the golf bag (10).

When it is desired to utilize the golf bag (10) of the present invention, the battery (110) is charged and inserted into the battery compartment (114) of the golf bag (10). The fluid container (148) is filled with a fluid and inserted into the golf bag (10) through the zippered door (178). Golf clubs (28) are then inserted into the ejector tubes (24) with sufficient force to engage the catches (84) and actuate the latches (76) against the pressure of the tubing (86). The remaining golf clubs (28) may thereafter be inserted into the stationary tubes (26). The golf bag (10) may thereafter be coupled to a golf cart (not shown), utilizing the web straps (192) and (194), and cam buckle (196), to couple the golf bag (10) to the web strap (198) and cam buckle (200) associated with the golf cart (not shown).

When it is desired to obtain a golf club (28) associated with one of the ejector tubes (24), a radio frequency remote control unit (202), such as those known in the art, is utilized. As shown in FIG. 1, the remote control unit (202) is provided with a plurality of buttons (204), (206), (208), (210), (212) and (214), associated with individual ejector tubes (24). As shown, the location of the buttons (204), (206), (208), (210), (212) and (214) are representative of the location of the ejector tubes (24) on the golf bag (10). When it is desired to obtain a desired golf club (28), the associated button (206) is depressed on the remote control (202). The radio frequency transmission associated with depression of the button (206) is received by the radio frequency receiver (108) located within the golf bag (10), which the central processing unit (106) translates into actuation of the associated ejector tube (24). (FIGS. 1 and 3). The central processing unit (106) thereafter sends an electronic signal to the solenoid (52) associated with the desired ejector tube (24). Upon receipt of the electronic impulse, the solenoid (52) causes the shaft (54) to retract, thereby causing the linkage (58) to move upward and pivot the secondary steel linkage (66) clockwise. (FIG. 6). As the secondary steel linkage (66) is pivotally coupled to the trigger bar (74), the trigger bar (74) also pivots clockwise, thereby causing the spring loaded catch (84) to release the unthreaded leg (100) of the U-bolt (96). (FIGS. 4, 5 and 6). Once released, the tubing (86) retracts, thereby drawing the attached threaded leg (98), and the cylinder (92) coupled thereto, rapidly upward through the tube (38). As the cylinder (92) moves upward through the tube (38), the cylinder (92) presses against the golf club (28), forcing it upward and out of the tube (38), whereafter a player (not shown) may grab the golf club (28) out of the air. In the preferred embodiment, the tubing (86) is sufficiently resilient so as to propel the golf club (28) completely clear of the tube (38) and golf bag (10). After the user is finished with the golf club (28), the golf club (28) may simply be reinserted into the tube (38) sufficiently to cause the unthreaded leg (100) to contact the catch (84) and cause the latch (76) to retain the unthreaded leg (100) until actuated again as noted above.

When it is desired to obtain a beverage from the golf bag (10), the button (216) associated with the linear actuator (116) is depressed, thereby sending a radio frequency signal from the remote control (202) to the radio frequency receiver (108). (FIGS. 1 and 3). The central processing unit (106) being coupled to the radio frequency receiver (108) translates the receipt of the signal into actuation of the linear actuator (116). The handle (142) of the tap (136) contacts a spring loaded plastic door (218) pivotally coupled to the top (20) of the golf bag (10) over an opening (220), sufficiently large to allow the cups (134) and tap (136) to extend upward therethrough to reveal the handle (142) and cups (134). (FIGS. 2 and 7).

Thereafter, a user may reach into the opening (164) in the top (20) of the golf bag (10) to pull the top (162) of the handle (160) upward, and thereafter begin pumping the handle (160) to sufficiently pressurize the fluid container (148). Once sufficient pressure has been obtained, a cup (134) may be removed from the cup form (128) and positioned below the tap (136). Thereafter, the handle (142) of the tap (136) may be pivoted to begin dispensing fluid (176) into the cup (134). Once a sufficient amount of fluid (176) has been dispensed, the handle (142) is tilted into its starting position. When no additional fluid (176) is required, a second button (217) associated with the linear actuator (116) is depressed, thereby causing the central processing unit (106) to cause the linear actuator (116) to retract the cup form (128) and tap (136) back into the golf bag (10). The spring loaded door (218) then closes as the cup form (128) and tap (136) retract into the golf bag (10), the door (218), and thereby leaving no indication of the presence of the cup form (128) or tap (136) within the golfbag (10). The handle (160) of the pump (158) may be thereafter pushed downward so that the only portion of the pump (158) visible from the top of the bag is the novelty handle (160), viewable through the opening (164).

When it is desired to utilize the stereo receiver (182), the zippered door (178) of the golf bag (10) is opened, and a separate remote control (222) associated with the stereo receiver is actuated to operate the stereo receiver (182) and video monitor (184). (FIGS. 1 and 2). If a DVD (190) is inserted into the stereo receiver (182), the DVD (190) will begin playing and displaying a video image (224) on the video monitor (184). When use of the stereo receiver (182) is no longer desired, the remote control (222) is again actuated to turn off the stereo receiver (182) and video monitor (184). Thereafter, the zippered door (178) may be closed over the stereo receiver (182) and video monitor (184) to protect it from the elements.

Although the invention has been described with respect to a preferred embodiment thereof, it is also to be understood it is not to be so limited, since changes and modifications can be made therein which are within the full, intended scope of this invention as defined by the appended claims.

What is claimed is:

1. A fluid delivery system comprising:

(a) a golf bag;

(b) means for retaining a plurality of golf clubs at least partially within said golf bag;

(c) a fluid container provided at least partially within said golf bag;

(d) a fluid dispenser;

(e) a fluid provided within said fluid dispenser;

(f) means for transporting said fluid from said fluid container to said fluid dispenser; and (g) means provided at least partially within said golf bag for driving said dispenser from a first position within said golf bag to a second position at least partially outside said golf bag.

2. The fluid delivery system of claim 1, wherein said pressurizing means is a pump.

3. The fluid delivery system of claim 1, wherein said fluid container has a capacity of at least two and one-half liters.

4. The fluid delivery system of claim 1, further comprising means coupled to said fluid container for releasing pressure from said fluid container upon pressure within said fluid container reaching a predetermined pressure.

5. A fluid delivery system comprising:

(a) a golf bag;

(b) means for retaining a plurality of golf clubs at least partially within said golf bag;

(c) a fluid container provided at least partially within said golf bag;

(d) a fluid dispenser;

(e) a fluid provided within said fluid dispenser;

(f) means for transporting said fluid from said fluid container to said fluid dispenser;

(g) means for moving said dispenser from a first position within said golf bag to a second position at least partially outside said golf bag;

(h) means for actuating said moving means; and (i) wherein said actuating means is a switch.

6. The fluid delivery system of claim 5, wherein said fluid dispenser is located above said fluid container.

7. The fluid delivery system of claim 5, wherein said moving means is electric.

8. The fluid delivery system of claim 5, further comprising a carriage, wherein said carriage is coupled to said fluid dispenser.

9. The fluid delivery system of claim 5, further comprising means above said golf bag for pressurizing said fluid container.

10. The fluid delivery system of claim 9, further comprising a carriage, wherein said carriage is coupled to said fluid dispenser.

11. The fluid delivery system of claim 10, wherein said moving means is means for moving said carriage.

12. A fluid delivery system comprising:

(a) a golf bag;

(b) means for retaining a plurality of golf clubs at least partially within said golf bag;

(c) a fluid container provided at least partially within said golf bag;

(d) a fluid dispenser;

(e) a fluid provided within said fluid dispenser;

(f) means for transporting said fluid from said fluid container to said fluid dispenser;

(g) means for moving said dispenser from a first position within said golf bag to a second position at least partially outside said golf bag;

(h) means for actuating said moving means from a distance of at least two meters from said moving means;

(i) further comprising means for actuating said moving means; and (j) wherein said actuating means is a radio frequency transmitter.

13. The fluid delivery system of claim 12, further comprising:

(a) means for storing a plurality of cups; and (b) means for extending said storing means from a third position within said golf bag to a fourth position above said golf bag.

14. A fluid delivery system comprising:

(a) a golf bag;

(b) means for retaining a plurality of golf clubs at least partially within said golf bag;

(c) a fluid container provided at least partially within said golf bag;

(d) a fluid dispenser coupled to said fluid container;

(e) means for moving said fluid dispenser from a first position within said golf bag to a second position at least partially outside said golf bag;

(f) means for actuating said moving means; and (g) wherein said actuating means is located above said fluid dispenser.

15. The fluid delivery system of claim 14, further comprising means for pressurizing said fluid container.

16. The fluid delivery system of claim 15, wherein said pressurizing means is a pump.

17. The fluid delivery system of claim 14, further comprising a carriage coupled to said fluid dispenser, and wherein said moving means comprises means for moving said carriage.

18. A fluid delivery system comprising:

(a) a golf bag;

(b) means for retaining a plurality of golf clubs at least partially within said golf bag;

(c) a fluid container provided at least partially within said golf bag;

(d) a fluid dispenser;

(e) means for moving said dispenser from a first position within said golf bag to a second position at least partially outside said golf bag;

(f) means for actuating said moving means;

(g) wherein said moving means is located outside said golf bag.

19. The fluid delivery system of claim 18, further comprising means for covering said dispenser and for obstructing said dispenser from view when said dispenser is in said first position.

20. The fluid delivery system of claim 18, further comprising a carriage coupled to said dispenser wherein said moving means is means for moving said carriage.

* * * * *